US009441393B1

(12) United States Patent
Muthusami

(10) Patent No.: US 9,441,393 B1
(45) Date of Patent: Sep. 13, 2016

(54) CEMETERY MEMORIAL

(71) Applicant: Jayakumar Muthusami, College Station, TX (US)

(72) Inventor: Jayakumar Muthusami, College Station, TX (US)

( * ) Notice: Subject to any disclaimer, the term of this patent is extended or adjusted under 35 U.S.C. 154(b) by 0 days.

(21) Appl. No.: 14/869,486

(22) Filed: Sep. 29, 2015

Related U.S. Application Data

(63) Continuation-in-part of application No. 13/934,159, filed on Jul. 2, 2013, which is a continuation of application No. 13/652,317, filed on Oct. 15, 2012, now Pat. No. 8,490,258.

(51) Int. Cl.
*E04H 13/00* (2006.01)
*A61G 17/08* (2006.01)

(52) U.S. Cl.
CPC ..... *E04H 13/008* (2013.01); *A61G 17/08* (2013.01); *E04H 13/003* (2013.01)

(58) Field of Classification Search
CPC .. A61G 17/08; E04H 13/003; E04H 13/008; A47G 7/06
USPC ..... 27/1; 52/103, 104; 40/124.5; 47/41.1
See application file for complete search history.

(56) References Cited

U.S. PATENT DOCUMENTS 3,460,961 A * 8/1969 Markhart ..... C08G 63/19 428/216
5,729,921 A * 3/1998 Rojas ..... E04H 13/006 27/1
6,076,292 A * 6/2000 Kawa ..... A61G 17/08 27/1
6,088,955 A * 7/2000 Nelson, Jr. ..... E04H 13/003 248/128
6,463,703 B1 * 10/2002 Mattis ..... E04H 13/003 52/103
6,800,167 B1 * 10/2004 Frazer ..... G09F 3/10 156/249
6,854,165 B1 * 2/2005 Parker ..... A61G 17/08 27/1
6,904,721 B1 * 6/2005 Forbes ..... E04H 13/008 52/103
7,036,195 B2 * 5/2006 Glass ..... A61G 17/08 27/1
7,406,754 B2 * 8/2008 Trail ..... E04H 13/008 27/1
7,562,423 B2 * 7/2009 Pryd-Kakuk ..... A61G 17/08 27/1
7,703,185 B2 * 4/2010 Trail ..... E04H 13/008 27/1
2002/0132871 A1 * 9/2002 Colton ..... B05D 1/40 522/7
2008/0034648 A1 * 2/2008 Rasmussen ..... E04H 13/003 47/41.1
2014/0215933 A1 * 8/2014 Carlson ..... E04H 13/008 27/1

FOREIGN PATENT DOCUMENTS

FR 2681624 A1 * 3/1993 ..... A61G 17/08

* cited by examiner

*Primary Examiner* — William Miller
(74) *Attorney, Agent, or Firm* — Nick A. Nichols, Jr.

(57) ABSTRACT

A cemetery memorial may include one or more receptacles for holding the cremation remains of a decedent. A cremation capsule may be secured in the receptacles and temporarily sealed in the memorial. The cremation capsule may be removed at a time after the cemetery memorial has been placed in a cemetery and cremation remains placed in the cremation capsule. The cremation capsule may thereafter be sealed in the cemetery memorial and concealed from view.

15 Claims, 9 Drawing Sheets

CEMETERY MEMORIAL

CROSS-REFERENCE TO RELATED APPLICATION

This is a continuation-in-part application of U.S. application Ser. No. 13/934,159, filed Jul. 2, 2013, which is a continuation of U.S. application Ser. No. 13/652,317, filed Oct. 15, 2012, now U.S. Pat. No. 8,490,258.

BACKGROUND OF THE INVENTION

The present invention relates generally to the funeral products industry, and more particularly, to a cemetery memorial including storage that may be accessed after the memorial has been placed in the cemetery to store the cremation remains of a future decedent.

Cremation is a growing segment of the funeral industry and there is a growing demand for new and innovative products to personalize and commemorate the lives of the deceased. The use of plastic bags or cardboard boxes to preserve and store cremation remains is not a desirable method of honoring the lives of loved ones.

There is a continuing demand in the funeral industry for new designs and styles of funeral products, particularly products that provide for a holistic approach for memorializing the lives of the deceased and bringing comfort to the family members of the deceased. Very few options are available for family members to have an individual or family cemetery memorial for a cremated decedent without the ashes of the decedent being buried in the ground or placed in a columbarium.

Cremation remains systems are disclosed in Muthusami U.S. Pat. No. 8,286,314 and U.S. Pat. No. 8,490,258, incorporated herein in their entity by reference. A capsule containing the cremation remains may be embeded in the memorial at the time that it is constructed. The capsule and cremation remains are completely concealed from view so that visitors to the cemetery and more particularly vandals will not be able to distinguish the cremation memorial from the other cemetery memorials. Only family members of the decedent and the cemetery management may know that the cremation remains of the decedent are embedded in the memorial.

There remains a need however for a cemetery memorial that provide a means for the storage of cremation remains in a memorial at a time after the memorial has been placed at a cemetery. Currently, cremation remains may be stored in a cemetery memorial at the time that the cemetery memorial is placed at a cemetery. Storing cremation remains in an existing memorial may be done but at considerable expense, as it would require equipment and personnel at the cemetery site to drill a compartment in the memorial and seal the decedent's remains therein.

SUMMARY

A cemetery memorial may include one or more receptacles for holding the cremation remains of a decedent. A cremation capsule may be secured in the receptacles and temporarily sealed in the memorial. The cremation capsule may be removed at a time after the cemetery memorial has been placed in a cemetery and cremation remains placed in the cremation capsule. The cremation capsule may thereafter be sealed in the cemetery memorial and concealed from view.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
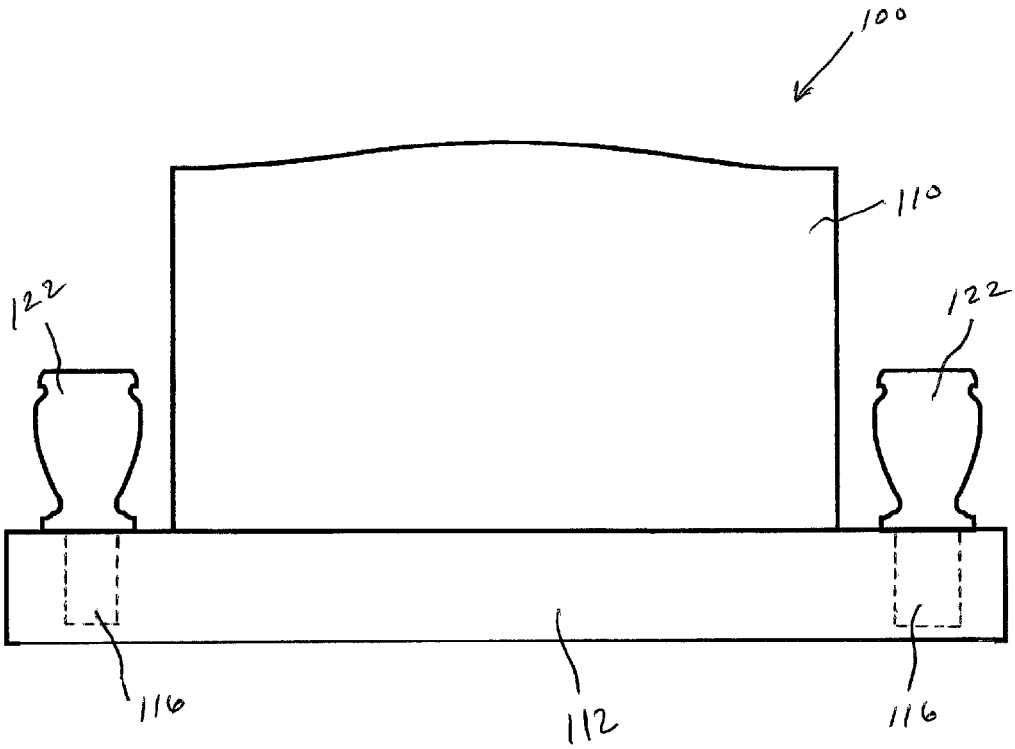
FIG. 1 is a partially broken away front elevation view of a cemetery memorial with receptacles for storage of cremation remains shown in phantom.

Referring first to FIG. 1, a first embodiment of a cemetery memorial is generally identified by the reference numeral 100. The memorial 100 may include an upright tablet 110 and a base 112. The base 112 may include one or more cavities or receptacles 116.

Figure 2:
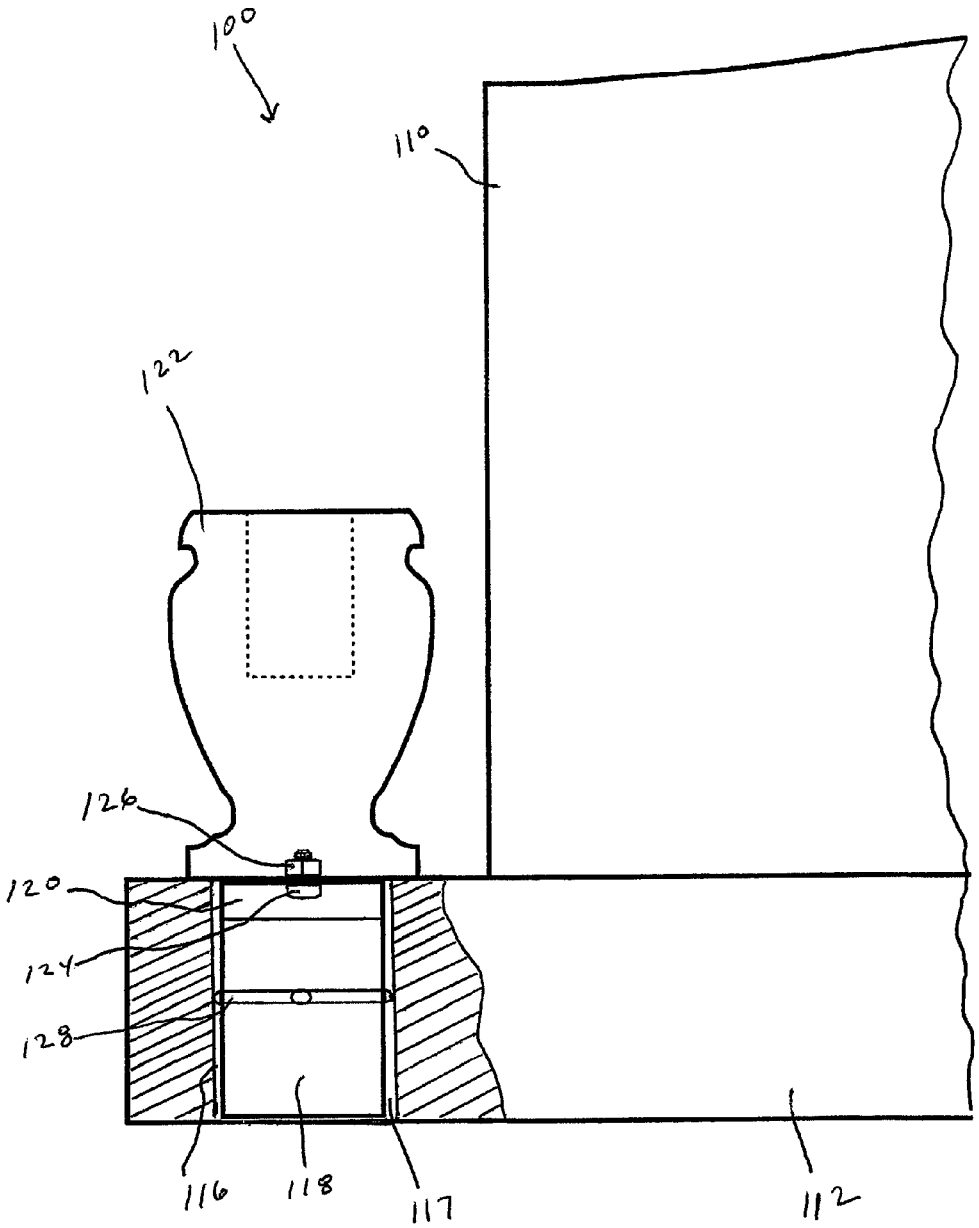
FIG. 2 is a partial section view depicting a cremation capsule is a receptacle of the cemetery memorial shown in FIG. 1.

Referring now to FIG. 2, the receptacles 116 are configured to receive a cremation capsule 118 that for illustrative purposes, but not by limitation, are depicted in some of the drawings as being cylindrical in shape. Other configurations may be possible, for example, but not by limitation, a substantially square shaped receptacle shown in FIG. 6.

The open end of the cremation capsule 118 may be closed by a removable lid 120. A vase 122 may cover the open end of the receptacle 116 to seal the cremation capsule 118 in the receptacle 116 and hide it from view. The cremation capsule 118 may be secured to the bottom of the vase 122 by a locking mechanism, such as a locking bolt 124 and locking nut 126. The locking nut 126 may be embedded in the base of the vase 122 and the locking bolt 124 may extend through the capsule lid 120 and threaded to the locking nut 126, thereby threadably securing the capsule lid 120 to the bottom of the vase 122.

A vase 122 is shown in the drawings for illustrative purposes. It is understood, however, that the term "vase" as used herein may include other forms, such as an angel, a cross, an animal and the like.

It will be observed that the receptacles 116 in the base 112 may have an internal diameter that is greater than the outer diameter of the cremation capsule 118. In such event, it may be difficult to center the cremation capsule 118 in the receptacle 116. Centering a cremation capsule 118 in the receptacle 116 may be conveniently accomplished by fitting a centering clamp or ring 128 about the cremation capsule 118. By way of example, but not by limitation, the centering ring 128 may be spring loaded and adjusts to fill the annular space 117 between the receptacle 116 and the cremation capsule 118, thereby centering the cremation capsule 118 in the receptacle 116. Centering of the cremation capsule 118 and the vase 122 is desirable to maintain the symmetry and visual appearance of the memorial 100.

Figure 3:
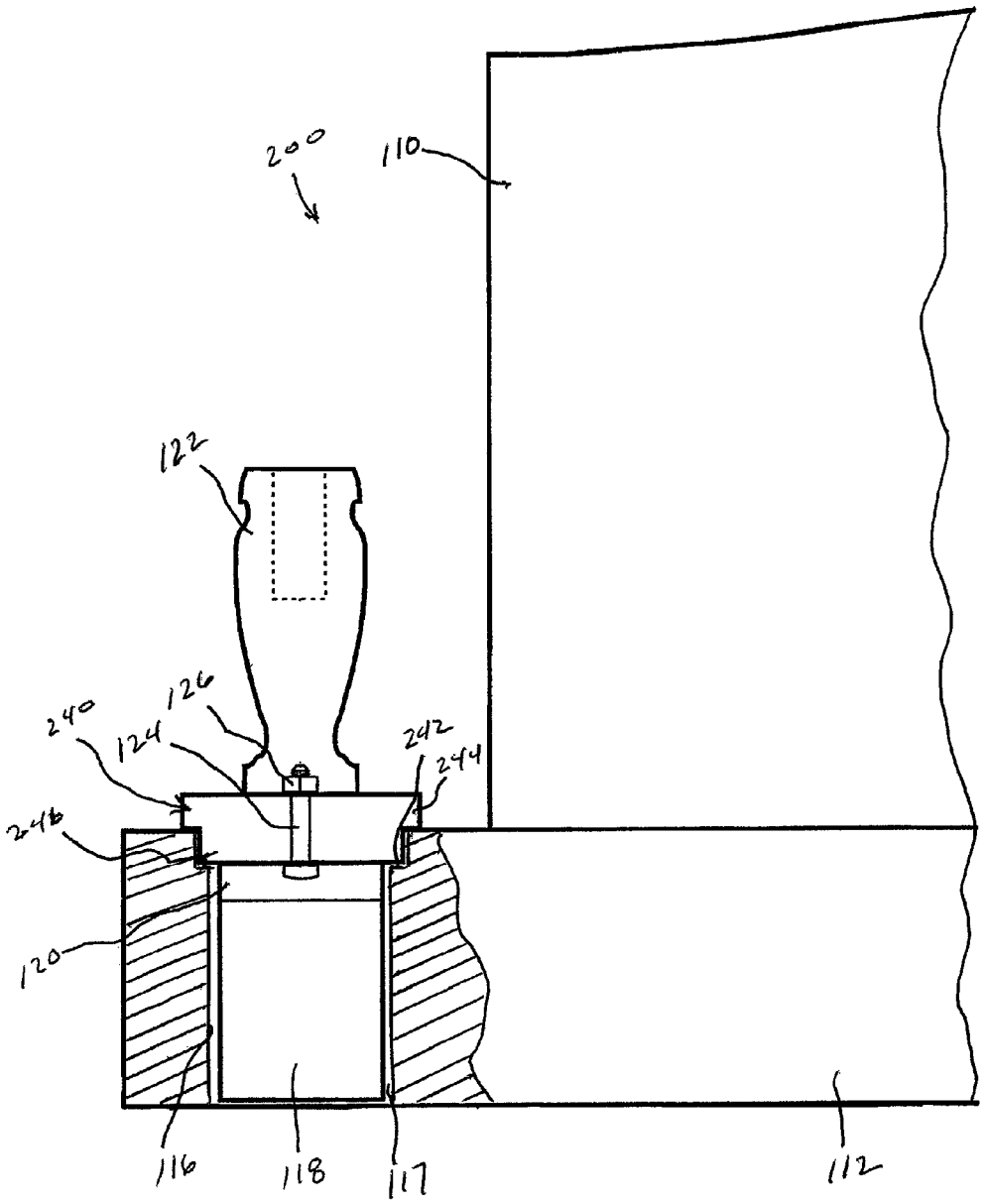
FIG. 3 is a partial section view depicting a cremation capsule is a receptacle of a second embodiment of a cemetery memorial.

Referring now to FIG. 3, a second embodiment of a memorial is generally identified by the reference numeral 200. As indicated by the use of common reference numerals, the memorial 200 is similar to the memorial 100 described hereinabove with the exception that the diameter of the base of the vase 122 is less than the diameter of the receptacle 116. An adapter 240 may be provided to close and seal the open end of the receptacle 116. To accommodate the adapter 240, the upper open end of the receptacle 116 may be countersunk to form a circumferential shoulder 242. The adapter 240 may include an upper portion 244 having a diameter greater than the diameter of the receptacle and a plug portion 246 extending downward from the upper portion 244. The plug portion 246 may be configured to fit into the countersunk end of the receptacle 116 to form a friction or interference fit connection therewith. The capsule lid 120 may be secured to the bottom of plug portion 246 of the adapter 240 by a bolt 124 and nut 126 as described hereinabove with reference to the memorial 100. It will be observed that the memorial 200 does not include a centering ring. The interface between the adapter 240 and the receptacle 116 centers the cremation capsule 118 in the receptacle 116 so that a centering ring is not required.

Figure 4:
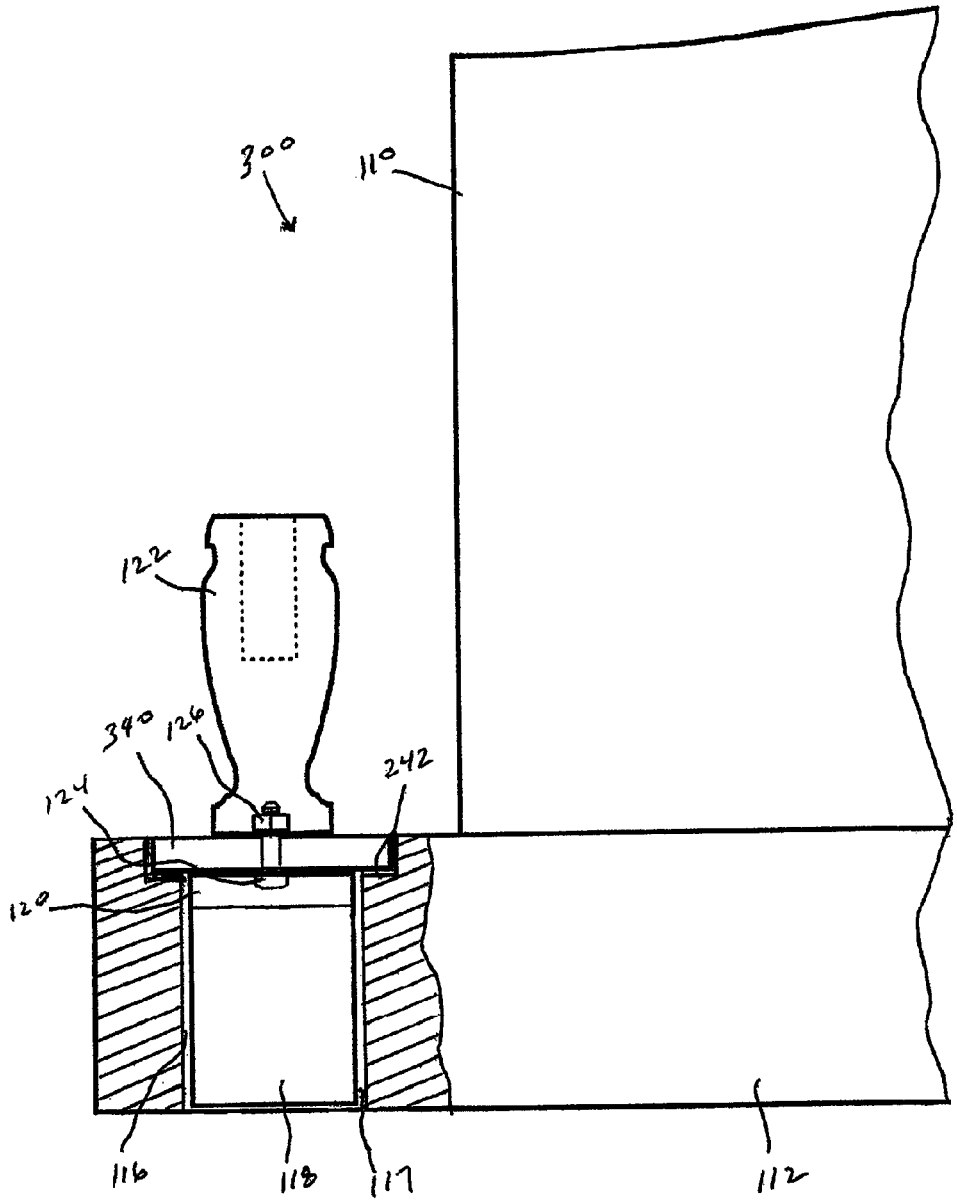
FIG. 4 is a partial section view depicting a cremation capsule is a receptacle of a third embodiment of a cemetery memorial.

Referring now to FIG. 4, a third embodiment of a memorial is generally identified by the reference numeral 300. As indicated by the use of common reference numerals, the memorial 300 is similar to the memorials 100 and 200 described hereinabove with the exception that an adapter 340 is configured to fit in the countersunk open end of the receptacle 118 flush with the top surface of the base 112. The vase 122 and capsule lid 120 may be centered on opposite sides of the adapter 340 and fixed in position by the bolt 124 and nut 126 locking mechanism described hereinabove with reference to the memorials 100 and 200. Like the memorial 200, it will be observed that the memorial 300 does not require a centering ring about the cremation capsule 118 to center the cremation capsule 118 in the receptacle 116.

Figure 5:
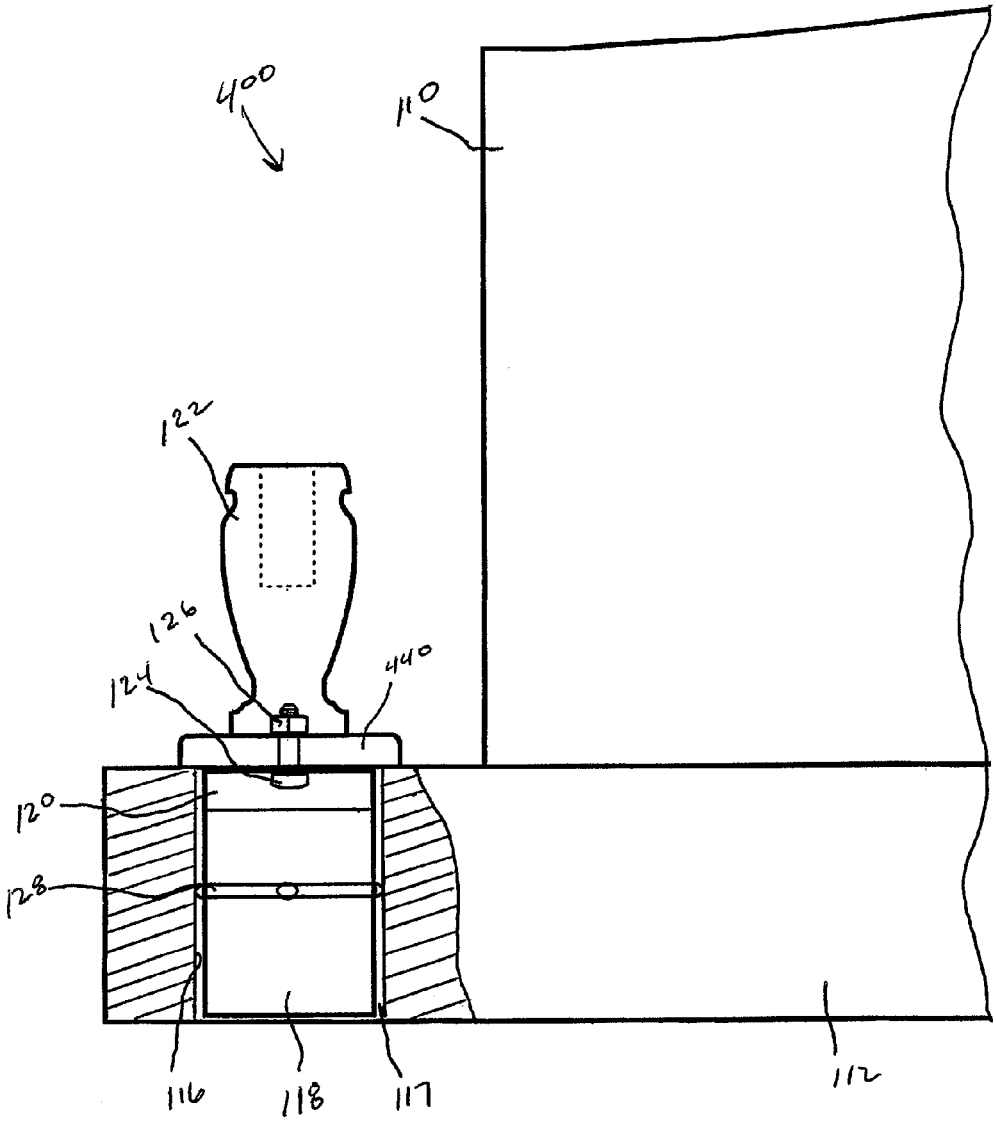
FIG. 5 is a partial section view depicting a cremation capsule is a receptacle of a fourth embodiment of a cemetery memorial.

Referring now to FIG. 5, a fourth embodiment of a memorial is generally identified by the reference numeral 400. As indicated by the use of common reference numerals, the memorial 400 is similar to the memorial 300 described hereinabove with the exception that the vase 122 is fixed on an adapter 440 that seals the cremation capsule 118 in the receptacle 116. The adapter 440 may be mounted to the top surface of the base 112 over the open end of the receptacle 116. The cremation capsule 118 may be removably secured to the adapter 440 in the manner described hereinabove with reference to the memorial 300 and may be centered in the receptacle 116 by a centering ring.

Figure 7:
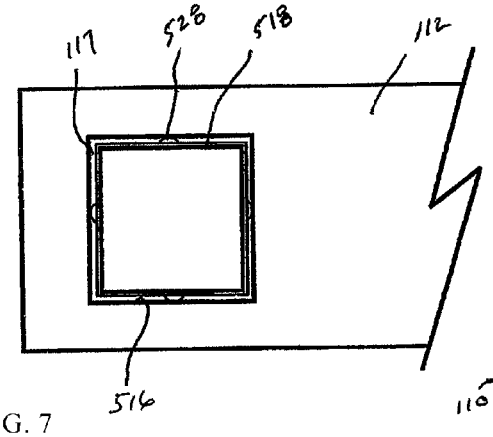
FIG. 7 is a partial top view of the cemetery memorial shown in FIG. 6.
Figure 6:
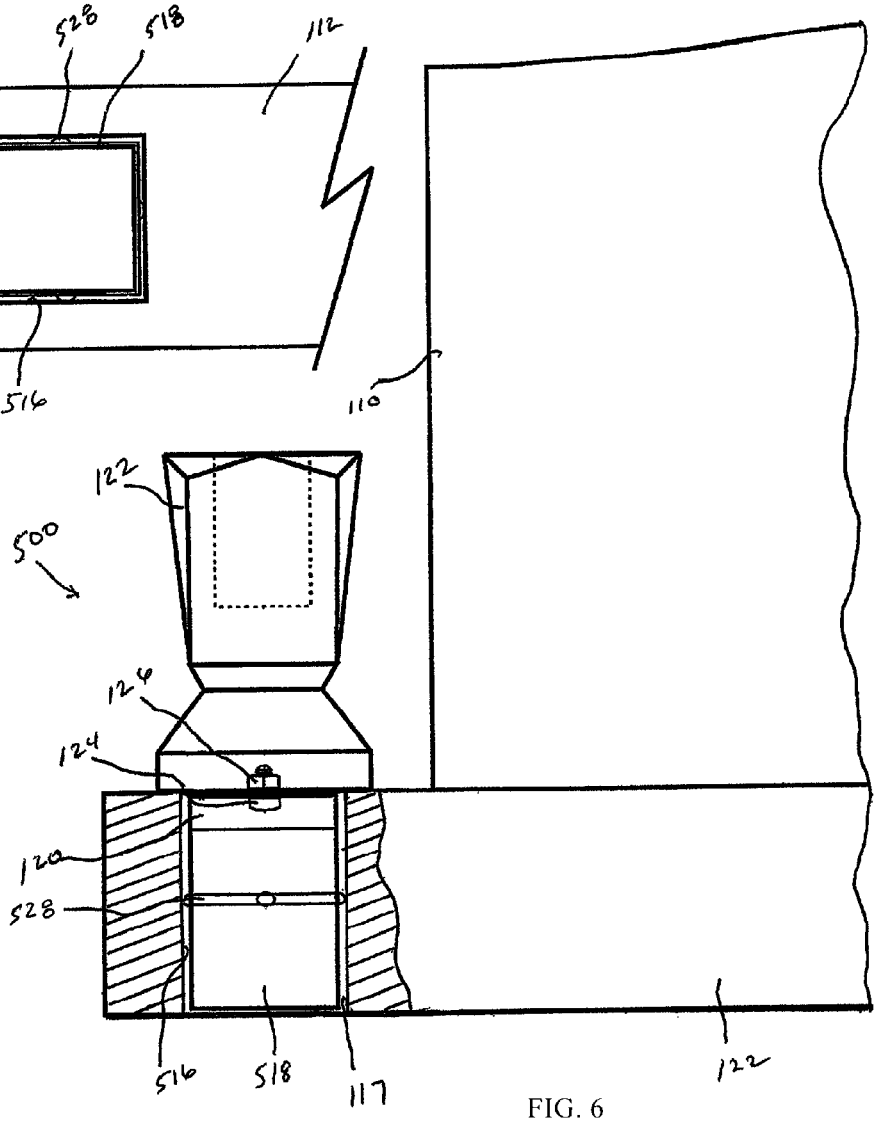
FIG. 6 is a partial section view depicting a cremation capsule is a receptacle of a fifth embodiment of a cemetery memorial.

Referring now to FIG. 6, a fifth embodiment of a cemetery memorial is generally identified by the reference numeral 500. As indicated by the use of common reference numerals, the memorial 500 is similar to the memorial 100 described hereinabove with the exception that the base 112 may include one or more substantially square shaped receptacles 516, best shown in the top plan view of FIG. 7, to accommodate a substantially square shaped cremation capsule 518. A positioning or centering ring 528 fixed about the cremation capsule 518 may center the cremation capsule 518 in the receptacle 516.

Figure 8:
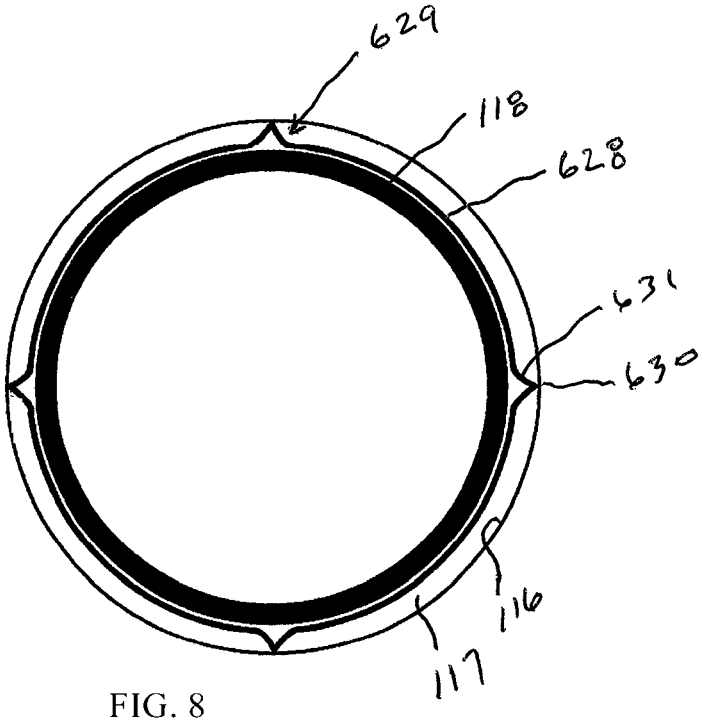
FIG. 8 is a top plan view depicting a centering ring about a cylindrical cremation capsule.
Figure 9:
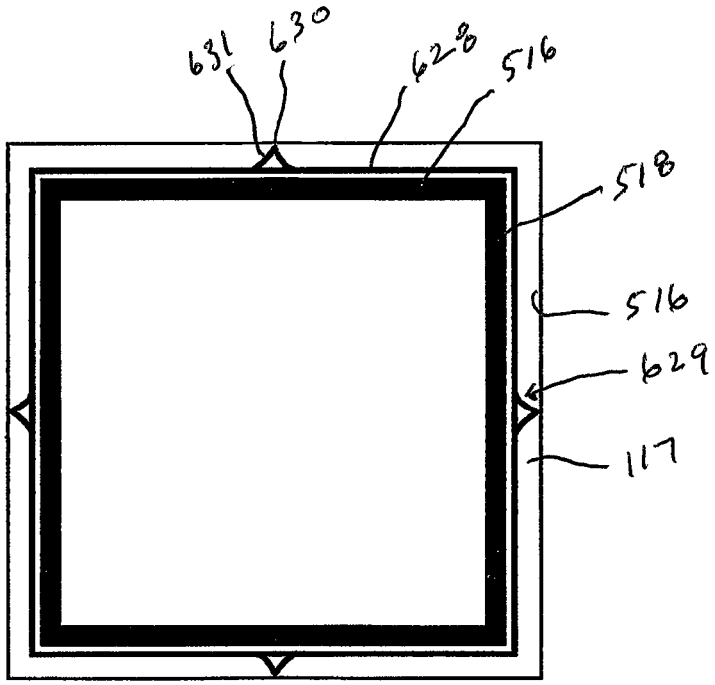
FIG. 9 is a top plan view depicting a centering ring about a square shaped cremation capsule.

Referring now to FIGS. 8-14, collectively, by way of example, but not by limitation, various configurations of centering rings are shown. In FIGS. 8 and 9, a centering ring 628 is illustrated mounted about a cylindrical cremation capsule 118 and a square cremation capsule 518, respectively. The centering ring 628 may include a plurality of crimps 629 forming a peak or edge 630 that contact the inner surface of a receptacle 116. In the event the annular space between the receptacle 116 and the cremation capsules 118, 518 is relatively small, the crimps 629 may flatten somewhat so that the legs 631 of the crimps 629 move laterally outwardly to accommodate the smaller annular space. In a larger annular space, the crimps 629 may spring back to their original shape.

Figure 10:
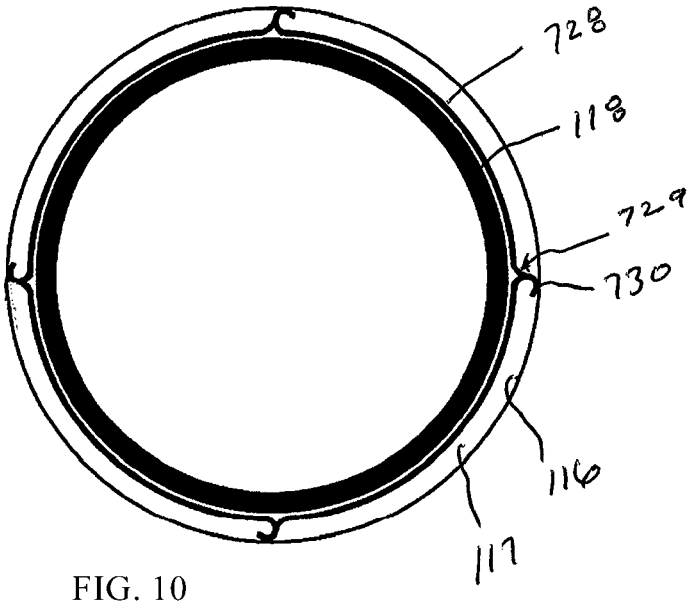
FIG. 10 is a top plan view of a second embodiment of a centering ring about a cylindrical cremation capsule.
Figure 11:
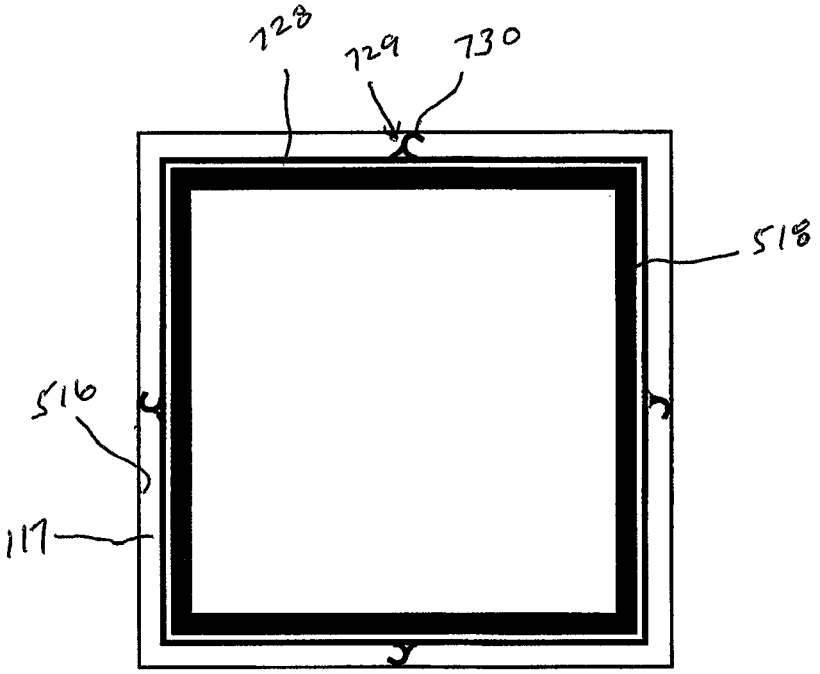
FIG. 11 is a top plan view depicting the centering ring shown in FIG. 10 about a square shaped cremation capsule.

In FIGS. 10 and 11, a centering ring 728 may include a plurality of crimps 729 that terminate in a curl 730. Radial pressure on the curls 730, which may be encountered in a relatively small annular space, tends to force the distal end of the curls 730 inwardly toward the receptacle 118. In a larger annular space, the curls 730 may spring back to their original shape.

Figure 12:
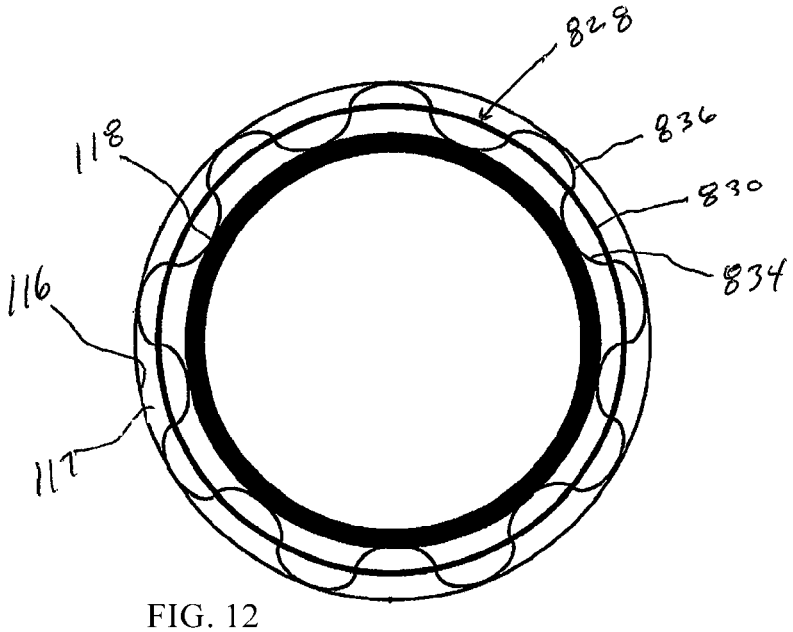
FIG. 12 is a top plan view depicting a third embodiment of a centering ring about a cylindrical cremation capsule.
Figure 13:
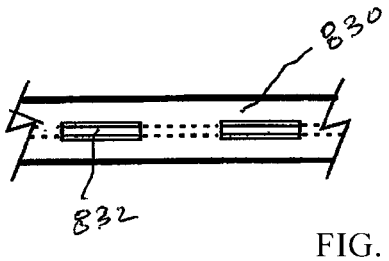
FIG. 13 is partial side view of the centering ring shown in FIG. 12.
Figure 14:
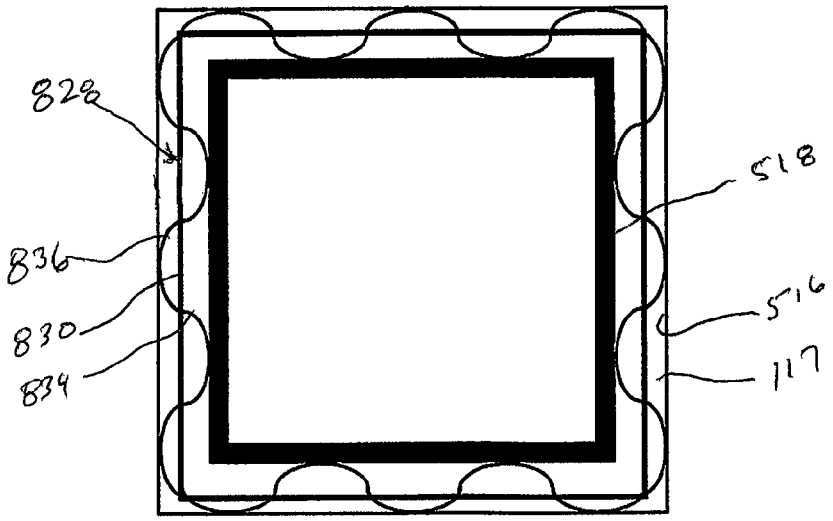
FIG. 14 is a top plan view depicting the centering ring shown in FIG. 12 about a square shaped cremation capsule.

In FIGS. 12-14, a centering ring 828 may comprise a band 830 including a plurality of slots 832. A flexible member 834, for example but not by limitation, may be threaded through the slots 832 so that loops 836 in the flexible member 834 extend through the slots 832 alternately contacting the inner surface of the receptacle 116 and the outer surface of the cremation capsule 118. Like the crimps 629 described hereinabove, the loops 836 may adjust to the annular space between the receptacle 116 and the cremation capsule 118.

In all the embodiments described above, the vase may be secured to the cemetery memorial with a releasable adhesive and the like. Thereafter, when cremation remains are to be interred in the cemetery memorial, the vase and the cremation capsule connected thereto may be removed from the cemetery memorial and the cremation remains placed in the cremation capsule. The cremation capsule and vase may then be returned and permanently fixed to the cemetery memorial, and thereby sealing the cremation capsule in the cemetery memorial concealed from view.

While preferred embodiments of the invention has been shown and described herein, other and further embodiments of the invention may be devised without departing from the basic scope thereof, and the scope thereof is determined by the claims which follow.

The invention claimed is:

1. A cemetery memorial, comprising:

a) a memorial having a receptacle formed therein;

b) a cremation capsule sized to fit within said receptacle, said cremation capsule including a removable lid;

c) a vase releasably secured to said memorial concealing said receptacle and said cremation capsule from view; and d) wherein said cremation capsule is releasably secured to said vase.

2. The cemetery memorial of claim 1 wherein said memorial includes one or more receptacles.

3. The cemetery memorial of claim 2 wherein said memorial includes a base having said one or more receptacles formed therein.

4. The cemetery memorial of claim 1 wherein said removable lid of said capsule is fixedly secured to a bottom surface of said vase.

5. The cemetery memorial of claim 1 including a centering ring mounted about said cremation capsule for centering said cremation capsule in said receptacle.

6. The cemetery memorial of claim 5 wherein said centering ring comprises a band having a plurality of openings and a flexible member threaded through said openings.

7. The cemetery memorial of claim 1 wherein said vase is in the form of a cross, a boot, an animal, or an angel.

8. The cemetery memorial of claim 1 including an adapter fixedly secured to a bottom of said vase, said cremation capsule being removably secured to a bottom surface of said adapter.

9. The cemetery memorial of claim 8 wherein a lower portion of said adapter is received in a countersunk open end of said receptacle.

10. The cemetery memorial of claim 1 wherein said receptacle is configured to receive a cylindrical cremation capsule.

11. The cemetery memorial of claim 1 wherein said receptacle is configured to receive a square shaped cremation capsule.

12. A cemetery memorial, comprising:

a) a memorial having one or more receptacles formed therein;

b) one or more cremation capsules sized to fit within said one or more receptacles, each said cremation capsules including a removable lid;

c) a vase secured to said memorial concealing each of said one or more receptacles from view;

d) wherein each of said one or more cremation capsules are releasably secured to said vase; and e) wherein said one or more cremation capsules are empty upon placement of said memorial at a cemetery and removed at a later time to receive cremains that are thereafter interred in said memorial.

13. The cemetery memorial of claim 12 wherein said removable lid of each said capsules is fixedly secured to a bottom surface of a respective said vase.

14. The cemetery memorial of claim 12 including an adapter fixedly secured to a bottom surface of said vase, and wherein said one or more cremation capsules are releasably secured to a bottom surface of said adapter.

15. The cemetery memorial of claim 12 including a centering ring mounted about said one or more capsules.

* * * * *